United States Patent [19]

Mollinger

[11] 3,993,087

[45] Nov. 23, 1976

[54] KINETIC STEEL SKELETON

[76] Inventor: Sebastian Mollinger, P.O. Box 157, Roxboro, Quebec, Canada, H8Y 3E9

[22] Filed: Apr. 1, 1974

[21] Appl. No.: 456,737

[30] Foreign Application Priority Data

Mar. 18, 1974 Canada ..... 195242

[52] U.S. Cl. ..... 135/3 R; 52/63; 135/DIG. 8

[51] Int. Cl.[2] ..... E04B 7/14

[58] Field of Search ..... 135/1 R, 312, DIG. 1, 9, 135/DIG. 8; 52/90, 639, 643, 63, 83, 79, 226, 641

[56] References Cited

UNITED STATES PATENTS

| | | | |
|---|---|---|---|
| 1,481,019 | 1/1924 | Luebbert | 52/83 |
| 1,958,296 | 5/1934 | Crow | 135/DIG. 1 |
| 2,666,507 | 1/1954 | Ruark | 52/643 |
| 2,693,195 | 11/1954 | Frieder et al. | 52/641 |
| 2,704,522 | 3/1955 | Frieder et al. | 135/3 R |
| 3,643,391 | 2/1972 | Mollinger | 52/83 |

*Primary Examiner*—Werner H. Schroeder
*Assistant Examiner*—Conrad L. Berman

[57] ABSTRACT

A kinetic steel skeleton for a modular tension structure permitting the enclosure of the structure by means of a flexible roofing and siding skin or by a flexible sandwich. The kinetic steel skeleton described herein has the shape of a rectangular tent but is not necessarily restricted to this shape.

7 Claims, 3 Drawing Figures

KINETIC STEEL SKELETON

BACKGROUND OF THE INVENTION

1. Field of Invention

The present invention relates to a kinetic steel skeleton in the field of tension structures. It permits the use of modular and flexible sheets or flexible sandwiches as the roofing and siding over a kinetic steel skeleton. Tension structures of this kind may be used where large column-free space is required such as for storage and warehouse buildings, factories, arenas, other recreational buildings, housing, hangars and the like.

2. Description of Prior Art

It is common at the present time to use rigid roofing deck and rigid sidings supported on rigid purlins and on rigid girts which in turn are supported on a rigid steel, rigid concrete or rigid timber skeleton thus becoming a relatively expensive structure, especially in the case of long span and column-free buildings.

SUMMARY OF THE INVENTION

The main object of the present invention is to provide considerably more economic means of enclosing large space. This is possible by use of a modular and flexible enclosure skin or sandwich that is mass-produced in a factory, rolled up, transported in a giant roll to the site and there unrolled over the kinetic steel skeleton and connected to the main cables thereof.

The steel skeleton is so designed as to provide as safe or a safer structure than presently used rigid structures although any part of or the whole superstructure will move within designed limits under certain loading conditions, more so than conventional rigid structures.

BRIEF DESCRIPTION OF THE INVENTION

Further features, objects and advantages will become evident in the detailed description of the preferred embodiments of the present invention in conjunction with the accompanying drawings in which.

DESCRIPTION OF THE PREFERRED EMBODIMENTS

Figure 1:
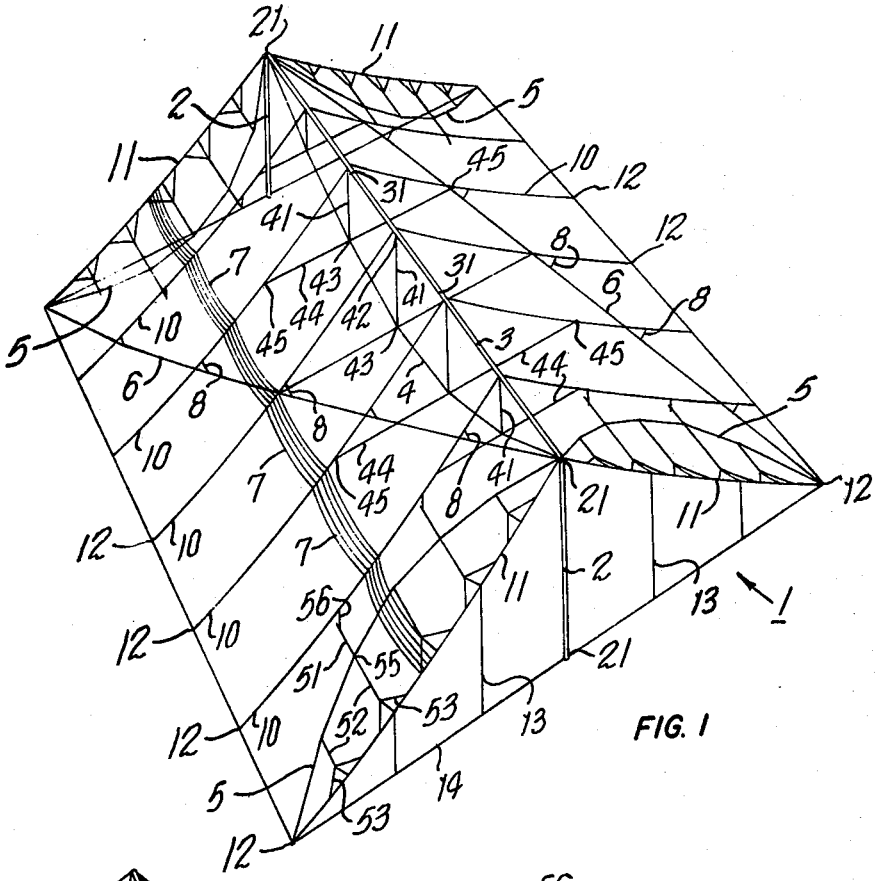
FIG. 1 is an isometric schematic view illustrating a preferred form of the present invention.

The basic kinetic steel skeleton 1 consists of very widely spaced vertical center columns 2 having two way hinges 21 secured at top and bottom thereof to allow the columns 2 to move under heavy wind loads. These hinges are of conventional design. A horizontal ridge beam 3 is also provided with several hinges 31. Main cables 10 are spaced apart and extending parallel to each other from the ridge beam 3 to their foundation anchors 12 each main cable forming a catenary. The thus far described skeleton would immediately collapse. To stabilize ridge beam 3 vertically, struts 41 will transfer the loads to a cable polygon 4 which brings the vertical components of its end reactions into columns 2 while the horizontal components will exert compression in the ridge beam thus creating a cable truss effect. Struts 41 have hinged connections 42 on top and 43 at the bottom. Horizontal wire rope stabilizers 44 serve a double purpose: being tautly connected at 45 to main cables 10 they will restrain main cables 10 from appreciable outward movement at points of connections 45 in case of wind suction and being also connected at 43 to the bottom of struts 41 they will prevent cable polygon 4 from flapping out of its vertical plane.

Numeral 13 denotes end vertical tension cables extending from the cables 11 to the base 14 of the end wall of the structure. All of the cables are connected together or anchored by conventional attachment devices.

The hinges 31 in ridge beam 3 also have a double purpose: one is to be able to fabricate and transport the individual sections of the ridge beam in manageable lengths, say 52 feet or even 26 feet lengths, and the other purpose is to avoid costly field welding or other moment connections. We obtain thus the unique structural case of a series of hinged members axially compressed but being prevented from buckling out of its vertical limits by struts 41 and cable polygon 4 and from buckling out of its horizontal limits by main cables 10.

Columns 2 are laterally stabilized by main cables 11 forming the four end catenaries of this tent-like structure. Longitudinal stability is achieved by two diagonal wire rope stabilizers 6, one of which extends from the top of the near column 2 to the bottom of the far end catenary 11 on one side of the building and the other from the top of the far column 2 to the bottom of the near end catenary 11 on the other side of the building.

Figure 2:
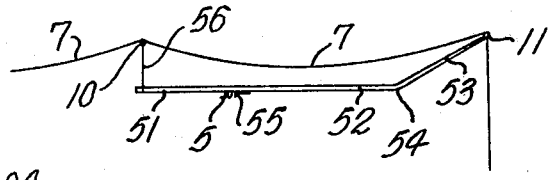
FIG. 2 is a section showing the arrangement that prevents end catenaries from being pulled inwards.

Both diagonal wire rope stabilizers 6 are to be strung under the main cables 10 and under the flexible covers 7. Spacing elements 8 between 10 and 6 may be required to prevent injury to the flexible covers 7. Flexible covers 7 will exert an unbalanced inward pull on each of the four end catenaries 11 at the ends of the structure. To counteract this a wire rope polygon 5 is strung underneath covers 7 from top of column 2 to the bottom of end catenary 11. The transfer of the unbalanced inward pull to wire rope polygon 5 will be effected by a series of struts 52 that are to be bent at 54 so as to avoid interference with covers 7 and that are connected to end catenaries 11 and to wire rope polygon 5 (see also FIG. 2). Every second strut 52 is to be extended by member 51 beyond its connection to wire rope polygon 5 to a point below the next main cable 10 and suspended therefrom by a tension member 56 so as to retain wire rope polygon 5 in a position just beneath flexible covers 7. In order to obtain further points of lateral support for end catenary 11 two secondary struts 53 are to branch out from bend 54 of each strut 52 in a crow foot-like manner.

Figure 3:
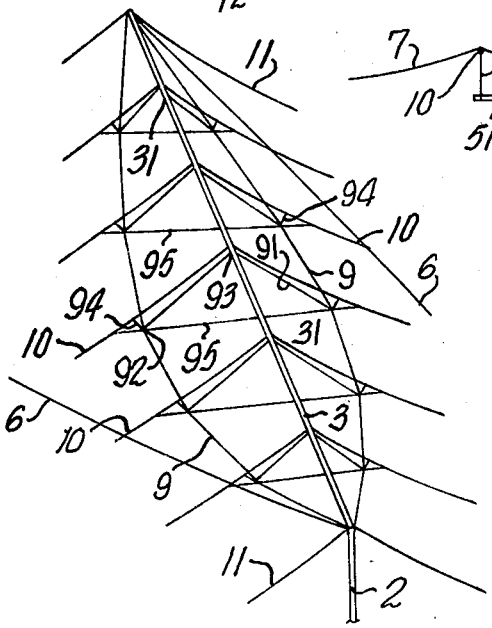
FIG. 3 shows an alternative support arrangement for the hinged ridge beam.

FIG. 3 illustrates an alternative vertical support arrangement for hinged ridge beam 3 where unobstructed height in the center is important as may be the case for enclosed tennis courts or where a conveyor is to discharge from the exact center of the building. In this case struts 91 will transfer the vertical loads from ridge beam 3 via hinged connection 93 at the ridge beam and hinged connection 92 to cable polygons 9. A spacing member 94 will retain cable polygons 9 at sufficient distance from main cables 10 so as to clear flexible covers 7. Horizontal wire rope stabilizers 95 will restrain main cables 10 from appreciable outward movement under wind suction conditions and will also prevent cable polygon 9 from flapping outward.

The embodiments of the invention in which an exclusive property or privilege is claimed are defined as follows:

1. A kinetic steel skeleton for a building for the attachment of modular and flexible covers, comprising opposed vertical center columns extending above a surface and secured to said surface in a hinge manner, a hinge connection secured to a top end of said columns and connected to a respective end of a flexible ridge beam supported therebetween, a plurality of spaced apart main cables extending parallel to each other and secured at one end to said ridge beam and at an opposite end to respective foundation anchorage points on said surface, a set of diagonal wire rope stabilizers each of which is secured at one end to a respective one of the center columns top end and extends to an opposed corner of the building where it is secured on said surface, a set of horizontal wire rope stabilizers secured to and extending between aligned pairs of main cables in a common vertical plane with a respective pair of said main cables, a set of wire rope polygons secured to and extending from each said top end of each said vertical center columns to a respective anchoring corner of the building in an inclined plane a plurality of spaced apart strut members secured to and extending from each of said polygons to a respective end one of said main cables to hold in position said end main cables to maintain said end main cables substantially in a vertical plane, said skeleton being adapted to receive flexible covers.

2. A kinetic steel skeleton as defined in claim 1, wherein said ridge beam is provided with hinges at spaced intervals and wherein said ridge beam is vertically supported by a series of vertical struts hingedly connected to said ridge beam and said horizontal wire rope stabilizers and a cable polygon extending under said ridge beam from one end of said ridge beam to the other end.

3. A kinetic steel skeleton as defined in claim 1, wherein said diagonal wire rope stabilizers extend diagonally across the underside of said plurality of spaced apart main cables, and wherein spacing elements are connected between said diagonal wire rope stabilizers and said main cables under which said stabilizers extend.

4. A kinetic steel skeleton as defined in claim 1, wherein said strut members are angulated members, some of said strut members extending beyond its connection with said wire rope polygon to a point beneath the adjacent main cable to said end main cable and suspended from said adjacent main cable by a tension member.

5. A kinetic steel skeleton as defined in claim 1, wherein two secondary struts are interconnected between a bend of said strut members and said end main cables in a crow foot-like manner to provide further lateral support for said end main cables.

6. A kinetic steel skeleton as defined in claim 1, wherein said vertical center columns are hinged to said ridge at said top end thereof.

7. A kinetic steel skeleton as defined in claim 6, wherein said vertical center columns are hinged at a connecting point on said surface.

* * * * *